US005458244A

United States Patent [19]

Emori

[11] Patent Number: 5,458,244

[45] Date of Patent: Oct. 17, 1995

[54] PACKAGE PACKED WITH VOLATILE SUBSTANCE

[75] Inventor: Shoichi Emori, Funabashi, Japan

[73] Assignee: 501 Seiken Kagaku Co., Ltd., Ichikawa, Japan

[21] Appl. No.: 6,148

[22] Filed: Jan. 19, 1993

Related U.S. Application Data

[63] Continuation of Ser. No. 651,831, Feb. 7, 1991.

[30] Foreign Application Priority Data

Feb. 8, 1990 [JP] Japan ..... 2-027150

[51] Int. Cl.[6] ..... B65D 25/08; B65D 79/00; B65D 73/00

[52] U.S. Cl. ..... 206/527; 206/219; 206/221; 206/484.1

[58] Field of Search ..... 206/219, 221, 206/222, 484.1, 527; 239/57, 60

[56] References Cited

U.S. PATENT DOCUMENTS 1,648,657 11/1927 Mock ..... 206/219
3,342,324 9/1967 Piazze ..... 206/219
4,007,831 2/1977 Bernhardt ..... 206/219
4,500,604 2/1985 Herold et al. ..... 156/331.1

FOREIGN PATENT DOCUMENTS 60-1727 of 0000 Japan .

OTHER PUBLICATIONS

"*Packaging*" vol. 31 No. 2 Feb. 1986 pp. 72–73 What Are Today's Trends In Europe and Japan?.

*Primary Examiner*—Jimmy G. Foster
*Assistant Examiner*—Marie Denise Patterson
*Attorney, Agent, or Firm*—Armstrong, Westerman, Hattori, McLeland and Naughton

[57] ABSTRACT

An inner bag made of an acrylonitrile-type thermoplastic resin film and having a volatile substance hermetically sealed therein is packed and sealed in an outer bag made of a gas-permeable film to provide a package packed with the volatile substance, which can keep the volatile substance from escaping therefrom during storage thereof, but permits the volatile substance to escape therefrom in service.

10 Claims, 1 Drawing Sheet

Fig.1
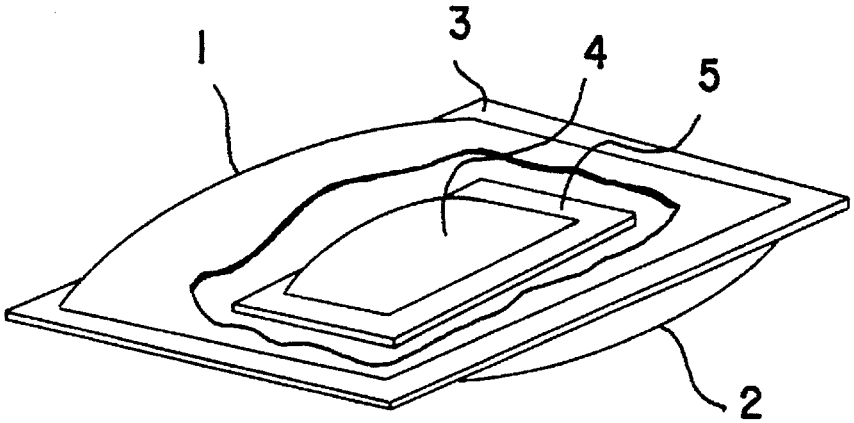
Fig.2
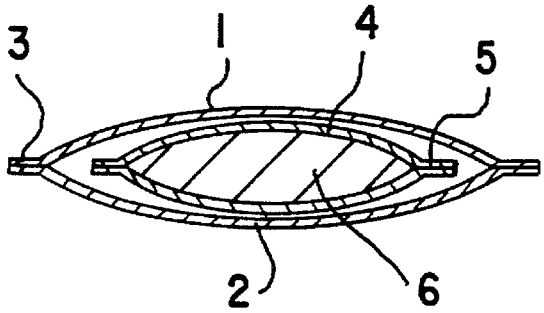
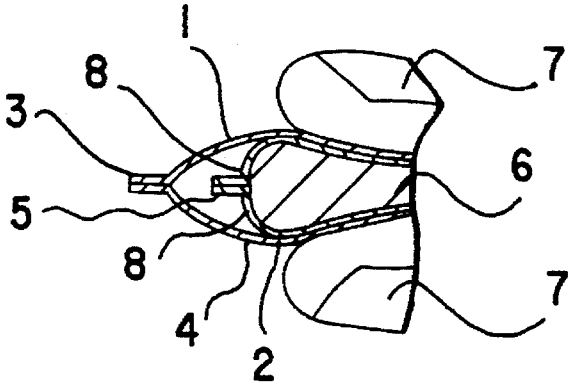
Fig.3

PACKAGE PACKED WITH VOLATILE SUBSTANCE

This application is a continuation of application Ser. No. 07/651,831 filed Feb. 7, 1991.

BACKGROUND OF THE INVENTION

1. Field of the Invention

The present invention relates to a package packed with a volatile substance such as a perfume, a deodorant, an insecticide, a mothball, a germicide, a mildewcide, a repellent, or a rust-proofing agent, which can come in handy.

2. Prior Art

Volatile substances to be volatilized when necessary have heretofore been hermetically packed and stored in bags or containers through which the volatile substances cannot permeate. When necessary, such bags or containers are opened to allow volatile substances to escape therefrom. However, this way of packaging has a liability to leak a liquid volatile substance in particular at the time of opening a bag or a container and/or during service thereof and therefore to pose a threat of contaminating therewith hands, clothes, etc., and involves a defect of a complicated operation of setting the volatile substance to escape.

A package packed with an aromatic, which is an improvement over the foregoing prior art, is disclosed in Japanese Utility Model Laid-Open No. 48,246/1983. The inner bag of this package is constituted of an innermost heat-sealing film, an interlayer gas-barrier film and a protective surface film. The inner bag packed with the aromatic, which is a volatile substance, is sealed at the sealing area of its open end portion with such a strength as to keep the sealed area of the end portion easy of peeling open, or rupture of the bag, when the bag packed with the aromatic is pressed strongly. The inner bag is hermetically packed in an outer bag or container comprising a gas-permeable film at least in part. This package packed with the aromatic is capable of spreading the gas of the aromatic through the gas-permeable film toward the outside of the package in service after the inner bag is ruptured by peeling open the sealed area thereof. The outer bag or container keeps the aromatic, particularly a liquid aromatic, from leaking out of the package to avoid contamination of other articles with the aromatic which would otherwise have leaked out of the package. Since the outer peripheral end of the inner bag is constituted of the cross sections of the films including the innermost heat-sealing film devoid of gas-barrier properties, however, the gas of the aromatic escapes from the above-mentioned outer peripheral end through the innermost heat-sealing film even during storage of the package. Thus, this package has a defect of poor keeping quality.

An object of the present invention is to provide a package of a construction similar to that of the foregoing package, which is packed with a volatile substance such as a perfume, a deodorant, an insecticide, a mothball, a germicide, a mildewcide, a repellent, or a rust-proofing agent, and which can keep the volatile substance from escaping therefrom during storage thereof but allow the volatile substance in service to easily escape from the outer bag thereof toward the outside of the package.

SUMMARY OF THE INVENTION

As a result of extensive investigations with a view to attaining the above-mentioned object, the author of the present invention has found out that the use of an acrylonitrile-type thermoplastic resin film as a material of an inner bag wherein a volatile substance is contained can sufficiently keep the volatile substance from escaping during storage and permits the inner bag to be easily ruptured by application thereto of an external pressure with fingers. The present invention has been completed based on this finding.

More specifically, in accordance with the present invention, there is provided a package comprising an inner bag made of an acrylonitrile-type thermoplastic resin film and having a volatile substance hermetically sealed therein, and an outer bag made of a gas-permeable film and having the inner bag packed therein.

Polyester, polyamide, vinylidene chloride, and like resins are known as having good gas-barrier properties. Where films of these resins having a thickness of 20 to 30 μgenerally best adapted for bag making are used to make inner bags, however, a force (peel force) of at least 2 kg/15 mm as an external pressure must be applied to the inner bags in order to cause rupture of the inner bags. Accordingly, it is next to impossible to cause rupture of the inner bags with fingers. By contrast, an inner bag made of an acrylonitrile-type thermoplastic resin film, when Dressed, undergoes rupture not through peeling open of the sealed area thereof but through break of the border area thereof between the bonded and non-bonded areas thereof. This enables the inner bag to be ruptured with a force of 300 to 800 g/15 mm. In this case, substantially the same level of force can cause rupture of the inner bag irrespective of whether the film thickness thereof is around 20 μ or around 30 μ.

The inner bag may be formed either of a single layer of the acrylonitrile-type thermoplastic resin film, or of a two-layer film having a layer of the acrylonitrile-type thermoplastic resin film and a layer of an easy-to-rupture aluminum foil laminated on the layer of the acrylonitrile-type thermoplastic resin film, though a choice of a layer structure may depend on the bag-making process (method of bonding).

BRIEF DESCRIPTION OF THE DRAWINGS

FIG. 1 is a perspective view of a package according to the present invention;

FIG. 2 is a cross-sectional view of a package according to the present invention; and FIG. 3 is an illustration of the package of the present invention being squeezed by a pair of fingers to cause rupture of the inner package.

DETAILED DESCRIPTION OF THE PREFERRED EMBODIMENT

An outer bag 1 is shown in FIGS. 1–3 having a sealed area 3. A reverse side 2 of the outer bag 1 is visible in FIG. 2. An inner bag 4 is contained within the outer bag 1, and has a sealed area 5. The inner bag 4 contains a volatile substance 6. As shown in FIG. 3, application of manual pressure by a pair of fingers 7 is employed in order to cause rupture of a rupturable portion 8.

The following Examples will now illustrate the present invention in more detail, but should not be construed as limiting the scope of the invention.

EXAMPLE 1

A 20 μ-thick acrylonitrile-type thermoplastic resin film (trade name: Zexlon, manufactured by Mitsui Toatsu Chemicals, Inc.) was used to make a bag having an internal size of 15 mm×20 mm through fusion bonding. 0.6 g of a liquid perfume was placed in the bag, which was then hermetically heat-sealed. This bag as an inner bag was packed and hermetically sealed in an outer bag having an internal size of 30 mm×30 mm and made of a polyethylene-laminated viscose paper (trade name: Saflon, manufactured by Fukui Chemical Co., Ltd.) to form a package packed with the perfume.

When the package was pressed from outside, the inner bag underwent rupture with a force of 400 g/15 mm.

EXAMPLE 2

A 20 μ-thick Zexlon film was used to make a bag having an internal size of 25 mm×30 mm through fusion bonding. 2 cc of limonene was placed in the bag, which was then hermetically heat-sealed. This bag was packed and hermetically sealed in a bag made of Saflon paper and having an internal size of 35 mm×40 mm. The resulting package packed with limonene underwent rupture of the inner bag with a force of 380 g/15 mm.

EXAMPLE 3

A 30 μ-thick Zexlon film was used to make a bag having an internal size of 30 mm×35 mm through fusion bonding. 3 g of a mixture of 30 wt. % of a liquid perfume and 70 wt. % of odorless kerosine was placed in the bag, which was then hermetically heat-sealed. This bag was packed and hermetically sealed in a bag made of Saflon paper and having an internal size of 40 mm×45 mm. The resulting package packed with the mixture underwent rupture of the inner bag with a force of 450 g/15 mm.

EXAMPLE 4

A 30 μ-thick Zexlon film was used to make a bag having an internal size of 25 mm×30 mm through fusion bonding. 2 ml of 20 wt. % aqueous formalin was placed in the bag, which was then hermetically heat-sealed. This bag was packed and hermetically sealed in a bag made of Saflon paper and having an internal size of 35 mm×40 mm. The resulting package packed with formalin underwent rupture of the inner bag with a force of 380 g/15 mm.

EXAMPLE 5

A laminated film of a 20 μ-thick Zexlon film having a 6 μ-thick aluminum foil laminated thereon was used to make a bag having an internal size of 50 mm×50 mm through fusion bonding. 5 g of ethanol was placed in the bag, which was then hermetically heat-sealed. This bag was packed and hermetically sealed in a bag made of Saflon paper and having an internal size of 60 mm×70 mm. The resulting package packed with ethanol underwent rupture of the inner bag with a force of 550 g/15 mm.

EXAMPLE 6

A laminated film of a 30 μ-thick Zexlon film having a 10 μ-thick aluminum foil laminated thereon was used to make a bag having an internal size of 25 mm×30 mm through fusion bonding. 2 g of water was placed in the bag, which was then hermetically heat-sealed. This bag was packed and hermetically sealed in a bag made of Saflon paper and having an internal size of 35 mm×40 mm. The resulting package packed with water underwent rupture of the inner bag with a force of 600 g/15 mm.

According to the present invention, the inner bag has high gas-barrier properties and good heat-sealing properties to satisfactorily keep a volatile substance from escaping during storage thereof. A simple operation of application of an external pressure only with fingers causes the inner bag to be ruptured, with the result that the volatile substance is allowed to escape in service.

What is claimed is:

1. A package, comprising:

an inner bag having a pair of facing walls fusion bonded at their edges to form an enclosure for containing a volatile liquid, each of said walls being composed of acrylonitrile thermoplastic resin film and having a thickness in a range of about 20 microns to about 30 microns; and an outer bag containing said inner bag, said outer bag being composed of a polyethylene-laminated viscose paper formed as a gas-permeable film; whereby application of a force in a range of about 300 to 800 g/15 mm to said outer bag causes rupture of said inner bag, wherein said inner bag is ruptured only through breaking of the border area thereof between the bonded and non-bonded areas thereof.

2. A package, comprising:

an inner bag having a pair of facing walls fusion bonded at their edges to form an enclosure for containing a volatile liquid, each of said walls being composed of acrylonitrile thermoplastic resin film and having a thickness of about 20 microns; and an outer bag containing said inner bag, said outer bag being composed of a polyethylene-laminated viscose paper formed as a gas-permeable film; whereby application of a force in a range of about 380 g/15 mm to about 400 g/15 mm to said outer bag causes rupture of said inner bag.

3. A package as claimed in claim 2, wherein said enclosure formed by said pair of facing walls of said inner bag has a border having an internal length of about 15 mm and an internal width of about 20 mm, said outer bag has an inner border having an internal length of about 30 mm and an internal width of about 30 mm, and wherein application of a force of about 400 g/15 mm to said outer bag causes rupture of said inner bag.

4. A package as claimed in claim 2, wherein said enclosure formed by said pair of facing walls of said inner bag has a border having an internal length of about 25 mm and an internal width of about 30 mm, an enclosure formed by said outer bag has an inner border having an internal length of about 35 mm and an internal width of about 40 mm, and wherein application of a force of about 380 g/15 mm to said outer bag causes rupture of said inner bag.

5. A package, comprising:

an inner bag having a pair of facing walls fusion bonded to form an enclosure for containing a volatile liquid, each of said walls being composed of acrylonitrile thermoplastic resin film and having a thickness of about 30 microns; and an outer bag containing said inner bag, said outer bag being composed of a polyethylene-laminated viscose paper formed as a gas-permeable film; whereby application of a force in a range of about 380 g/15 mm to about 450 g/15 mm to said outer bag causes rupture of said inner bag.

6. A package as claimed in claim 5, wherein said enclosure formed by said pair of facing walls of said inner bag has a border having an internal length of about 30 mm and an internal width of about 35 mm, said outer bag has an inner border having an internal length of about 40 mm and an internal width of about 45 mm, and wherein application of a force of about 450 g/15 mm to said outer bag causes rupture of said inner bag.

7. A package as claimed in claim 5, wherein said enclosure formed by said pair of facing walls of said inner bag has a border having an internal length of about 25 mm and an internal width of about 30 mm, an enclosure formed by said outer bag has an inner border having an internal length of about 35 mm and an internal width of about 40 mm, and wherein application of a force of about 380 g/15 mm to said outer bag causes rupture of said inner bag.

8. A package, comprising:

an inner bag having a pair of facing walls fusion bonded to form an enclosure for containing a volatile liquid, each of said walls being composed of a laminate of an aluminum foil and an acrylonitrile thermoplastic resin film, said acrylonitrile thermoplastic resin film having a thickness in a range of about 20 microns to about 30 microns; and an outer bag containing said inner bag, said outer bag being composed of a polyethylene-laminated viscose paper formed as a gas-permeable film; whereby application of a force in a range of about 550 g/15 mm to about 600 g/15 mm to said outer bag causes rupture of said inner bag.

9. A package as claimed in claim 8, wherein said aluminum foil has a thickness of about 6 microns, said acrylonitrile thermoplastic resin film has a thickness of about 20 microns, said enclosure formed by said pair of facing walls of said inner bag has a border having an internal length of about 50 mm and an internal width of about 50 mm, and said outer bag has an inner border having an internal length of about 60 mm and an internal width of about 70 mm; and wherein application of a force of about 550 g/15 mm to said outer bag causes rupture of said inner bag.

10. A package as claimed in claim 8, wherein said aluminum foil has a thickness of about 10 microns, said acrylonitrile thermoplastic resin film has a thickness of about 30 microns, said enclosure formed by said pair of facing walls of said inner bag has a border having an internal length of about 25 mm and an internal width of about 30 mm, and said outer bag has an inner border having an internal length of about 35 mm and an internal width of about 40 mm; and wherein application of a force of about 600 g/15 mm to said outer bag causes rupture of said inner bag.

* * * * *

UNITED STATES PATENT AND TRADEMARK OFFICE

CERTIFICATE OF CORRECTION

PATENT NO. : 5,458,244
DATED : October 17, 1995
INVENTOR(S) : Shoichi EMORI

It is certified that error appears in the above-indentified patent and that said Letters Patent is hereby corrected as shown below:

On the cover page, Item [73], please delete "501" from "501 Seiken Kagaku Co., Ltd." to show --Seiken Kagaku Co., Ltd.--.

Signed and Sealed this

Sixteenth Day of April, 1996

Bruce Lehman

*Attest:*

BRUCE LEHMAN

*Attesting Officer*

*Commissioner of Patents and Trademarks*